US009659579B2

(12) United States Patent
Beerends

(10) Patent No.: US 9,659,579 B2
(45) Date of Patent: May 23, 2017

(54) METHOD OF AND APPARATUS FOR EVALUATING INTELLIGIBILITY OF A DEGRADED SPEECH SIGNAL, THROUGH SELECTING A DIFFERENCE FUNCTION FOR COMPENSATING FOR A DISTURBANCE TYPE, AND PROVIDING AN OUTPUT SIGNAL INDICATIVE OF A DERIVED QUALITY PARAMETER

(71) Applicant: Nederlandse Organisatie voor toegepast-natuurwetenschappelijk onderzoek TNO, Delft (NL)

(72) Inventor: John Gerard Beerends, Delft (NL)

(73) Assignee: Nederlandse Organisatie voor toegepast-natuurwetenschappelijk onderzoek TNO, Delft (NL)

( * ) Notice: Subject to any disclaimer, the term of this patent is extended or adjusted under 35 U.S.C. 154(b) by 133 days.

(21) Appl. No.: 14/358,730

(22) PCT Filed: Nov. 15, 2012

(86) PCT No.: PCT/NL2012/050807
§ 371 (c)(1),
(2) Date: May 16, 2014

(87) PCT Pub. No.: WO2013/073943
PCT Pub. Date: May 23, 2013

(65) Prior Publication Data

US 2014/0316773 A1 Oct. 23, 2014

(30) Foreign Application Priority Data

Nov. 17, 2011 (EP) ..... 11189593

(51) Int. Cl.
*G10L 25/60* (2013.01)
*G10L 25/69* (2013.01)

(52) U.S. Cl.
CPC ..... *G10L 25/60* (2013.01); *G10L 25/69* (2013.01)

(58) Field of Classification Search
CPC ..... G10L 25/60; G10L 25/69
See application file for complete search history.

(56) References Cited

U.S. PATENT DOCUMENTS 5,867,813 A * 2/1999 Di Pietro ..... G10L 25/69 704/202
9,031,837 B2 * 5/2015 Homma ..... G10L 25/69 455/67.13

(Continued)

FOREIGN PATENT DOCUMENTS

EP 2048657 A1 4/2009
EP 2372700 A1 10/2011
NL EP 2922058 A1 * 9/2015 ..... G10L 25/69

OTHER PUBLICATIONS

Yi Gaoxiong, Zhang Wei; "The Perceptual Objective Listening Quality Assessment algorithm in Telecommunication: Introduction of ITU-T new metrics POLQA", Aug. 17, 2012, IEEE, Communications in China (ICCC), 2012 1st IEEE Conference, pp. 351-355.*

(Continued)

*Primary Examiner* — Tammy Paige Goddard
*Assistant Examiner* — Walter Yehl
(74) *Attorney, Agent, or Firm* — Banner & Witcoff, Ltd.

(57) ABSTRACT

The present invention relates to a method of evaluating intelligibility of a degraded speech signal received from an audio transmission system conveying a reference signal. The method comprises sampling said reference and degraded signal into frames, and forming frame pairs. For each pair one or more difference functions representing a difference between the degraded and reference signal are provided. A difference function is selected and compensated for different disturbance types, such as to provide a disturbance density (Continued)

function adapted to human auditory perception. An overall quality parameter is determined indicative of the intelligibility of the degraded signal. The method comprises determining a switching parameter indicative of audio power level of said degraded signal, for performing said selecting.

20 Claims, 6 Drawing Sheets

(56) References Cited

U.S. PATENT DOCUMENTS

2005/0159944 A1* 7/2005 Beerends ..... G10L 25/69 704/225
2007/0192098 A1* 8/2007 Zumsteg ..... G10L 25/69 704/240
2009/0112584 A1* 4/2009 Li ..... G10L 21/0208 704/233
2010/0211395 A1* 8/2010 Beerends ..... G10L 25/69 704/270
2012/0069888 A1* 3/2012 Grancharov ..... G10L 25/69 375/224
2015/0199959 A1* 7/2015 Skoglund ..... G10L 25/60 704/239
2015/0340047 A1* 11/2015 Beerends ..... G10L 21/02 704/201

OTHER PUBLICATIONS

International Search Report—PCT/NL2012/050807—mailing date: Jan. 30, 2013.
"Recommendation P.863, Perceptual objective listening quality assessment", International Telecommunication Union ITU-T, Jul. 8, 2011 (Jul. 8, 2011). Feb. 6, 2012 (Feb. 6, 2012), XP002668947, Retrieved from the Internet: URL: http://mirror.itu.int/dms/pay/itu-t/rec/p/T-REC-P.863-201101-I! !SOFT-ZST-E.zip [retrieved on Feb. 6, 2012].
Beerends John G et al: "Objective Speech Intelligibility Measurement on the Basis of Natural Speech in Combination with Perceptual Modeling". JAES, AES, 60 East 42nd Street, Room 2520 New York 10165-2520, USA. vol. 57, No. 5, May 1, 2009 (May 1, 2009), pp. 299-308, XP040508904.
International Search Report—PCT/NL2012/050808—Mailing date: Jan. 30, 2013.

* cited by examiner

Short sinusoidal tone
187
Masking threshold for a second short sinusoidal tone
188
Intensity
185
time Short sinusoidal tone
198
Masking threshold for a second short sinusoidal tone
199
Intensity
195
Frequency Masking threshold used as suppression strength leading to a sharpened internal representation
211
210
Time
Intensity
205
Frequency

METHOD OF AND APPARATUS FOR EVALUATING INTELLIGIBILITY OF A DEGRADED SPEECH SIGNAL, THROUGH SELECTING A DIFFERENCE FUNCTION FOR COMPENSATING FOR A DISTURBANCE TYPE, AND PROVIDING AN OUTPUT SIGNAL INDICATIVE OF A DERIVED QUALITY PARAMETER

CROSS-REFERENCE TO RELATED APPLICATIONS

This application is a U.S. National Stage application under 35 U.S.C. §371 of International Application PCT/NL2012/050807 (published as WO 2013/073943 A1), filed Nov. 15, 2012, which claims priority to Application EP 11189593.4, filed Nov. 17, 2011. Benefit of the filing date of each of these prior applications is hereby claimed. Each of these prior applications is hereby incorporated by reference in its entirety.

FIELD OF THE INVENTION

The present invention relates to a method of evaluating intelligibility of a degraded speech signal received from an audio transmission system, by conveying through said audio transmission system a reference speech signal such as to provide said degraded speech signal, wherein the method comprises sampling said reference speech signal into a plurality of reference signal frames, sampling said degraded speech signal into a plurality of degraded signal frames, and forming frame pairs by associating said reference signal frames and said degraded signal frames with each other, for each frame pair pre-processing said reference signal frames and said degraded signal frames for enabling a comparison between said frames of each frame pair, and providing for each frame pair one or more difference functions representing a difference between said degraded signal frame and said associated reference signal frame.

The present invention further relates to an apparatus for performing a method as described above, and to a computer program product.

BACKGROUND

During the past decades objective speech quality measurement methods have been developed and deployed using a perceptual measurement approach. In this approach a perception based algorithm simulates the behaviour of a subject that rates the quality of an audio fragment in a listening test. For speech quality one mostly uses the so-called absolute category rating listening test, where subjects judge the quality of a degraded speech fragment without having access to the clean reference speech fragment. Listening tests carried out within the International Telecommunication Union (ITU) mostly use an absolute category rating (ACR) 5 point opinion scale, which is consequently also used in the objective speech quality measurement methods that were standardized by the ITU, Perceptual Speech Quality Measure (PSQM (ITU-T Rec. P.861, 1996)), and its follow up Perceptual Evaluation of Speech Quality (PESQ (ITU-T Rec. P.862, 2000)). The focus of these measurement standards is on narrowband speech quality (audio bandwidth 100-3500 Hz), although a wideband extension (50-7000 Hz) was devised in 2005. PESQ provides for very good correlations with subjective listening tests on narrowband speech data and acceptable correlations for wideband data.

As new wideband voice services are being rolled out by the telecommunication industry the need emerged for an advanced measurement standard of verified performance, and capable of higher audio bandwidths. Therefore ITU-T (ITU-Telecom sector) Study Group 12 initiated the standardization of a new speech quality assessment algorithm as a technology update of PESQ. The new, third generation, measurement standard, POLQA (Perceptual Objective Listening Quality Assessment), overcomes shortcomings of the PESQ P.862 standard such as incorrect assessment of the impact of linear frequency response distortions, time stretching/compression as found in Voice-over-IP, certain type of codec distortions and reverberations.

Although POLQA (P.863) provides a number of improvements over the former quality assessment algorithms PSQM (P.861) and PESQ (P.862), the present versions of POLQA, like PSQM and PESQ, fail to address an elementary subjective perceptive quality condition, namely intelligibility. Despite also being dependent on a number of audio quality parameters, intelligibility is more closely related to the quality of information transfer than to the quality of sound. In terms of the quality assessment algorithms, the nature of intelligibility as opposed to sound quality causes the algorithms to yield an evaluation score that mismatches the score that would have been assigned if the speech signal had been evaluated by a person or an audience. Keeping in focus the objective of information sharing, a human being will value an intelligible speech signal above a signal which is less intelligible but which is similar in terms of sound quality. The presently known algorithms will not be able to correctly address this to the extent required.

SUMMARY OF THE INVENTION

It is an object of the present invention to seek a solution for the abovementioned disadvantage of the prior art, and to provide a quality assessment algorithm for assessment of (degraded) speech signals which is adapted to take intelligibility of the speech signal into account for the evaluation thereof.

The present invention achieves this and other objects in that there is provided a method of evaluating intelligibility of a degraded speech signal received from an audio transmission system, by conveying through said audio transmission system a reference speech signal such as to provide said degraded speech signal, wherein the method comprises: sampling said reference speech signal into a plurality of reference signal frames, sampling said degraded speech signal into a plurality of degraded signal frames, and forming frame pairs by associating said reference signal frames and said degraded signal frames with each other; for each frame pair pre-processing said reference signal frames and said degraded signal frames for enabling a comparison between said frames of each frame pair; providing for each frame pair one or more difference functions representing a difference between said degraded signal frame and said associated reference signal frame; selecting at least one of said difference functions for compensating said at least one of said difference functions for one or more disturbance types, such as to provide for each frame pair one or more disturbance density functions adapted to a human auditory perception model, wherein said selecting is performed by comparing a disturbance level of said degraded signal with a threshold disturbance level; and deriving from said disturbance density functions of a plurality of frame pairs an overall quality parameter, said quality parameter being at least indicative of said intelligibility of said degraded speech signal; wherein said method comprises a step of determining at least one switching parameter indicative of an audio power level of said degraded signal, and using said at least one switching parameter for determining or adapting said threshold disturbance level that is used in performing said selecting of said at least one of said difference functions for optimizing said method for audio power level conditions of said degraded signal for assessment of said intelligibility of said degraded speech signal for said evaluation.

The present invention addresses intelligibility by recognising that disturbances are to be treated different dependent on the audio power of the degraded signal. As an example, if the degraded signal is of an overall weak level, certain kind of disturbances (such as for example regular noise) are considered far more annoying and detrimental to intelligibility than when the overall audio power level of the degraded signal is strong. It is therefore beneficial to take this effect into account upon switching between the various difference functions, such as to make sure that various types of disturbances are correctly taken into account under the various conditions represented by the various difference functions.

Human perception deals differently with disturbance dependent on the intensity thereof, causing a real person to assess the quality of a signal also different for either loud or weak disturbances. An example of this is the masking effect of human perception (as illustrated in FIG. 5, and described in this description). Human perception has the tendency to mask weaker audible signals dependent on their temporal proximity to louder signals and dependent on whether or not these are received before or after the louder signal. A similar masking effect can be seen in the frequency domain, as human perception is not capable of distinguishing two (almost) simultaneous tones of slightly different frequency, in particular when one of the tones is louder than the other (the weaker signal being masked by the stronger signal). A strong disturbance will therefore be experienced as very annoying since it masks parts of (or the whole) actual signal. On the other hand, weak disturbances may not even be perceived or noticed, as such disturbances may be masked by the actual signal if it is sufficiently loud. In order to make a proper assessment of quality in terms of intelligibility of a speech signal, it is necessary to distinguish between loud and weak disturbances, using a threshold disturbance level, and to treat these differently for taking into account the masking effect of human auditory perception properly.

PESQ and its predecessor PSQM had taken asymmetry of human perception into account to some extend by distinguishing between added disturbances on one hand and other disturbances (such as absent frequency components) on the other hand. Although this asymmetry is also a very important effect to take into account, further improvement is achieved by taking into account the intensity of the disturbance in combination with the play back level of the degraded signal.

This yields four versions of a difference function as used in POLQA, and the evaluation requires switching between different versions such as to apply the right kind of processing under various conditions. In previous versions of POLQA this switching is only dependent on a threshold disturbance level as determined in a first model run. In the present invention this switching is performed by using the overall audio power of the degraded signal, or the overall audio power ratio between the degraded signal and the reference signal (this is effectively the same, since the overall power level of the reference signal is at a constant level), in combination with the threshold disturbance level resulting in a switching parameter optimized threshold level. A more sophisticated and improved embodiment takes into account the per frame audio power ratio between the degraded and reference signal, for each of the frames to be processed. The switching is then perform by comparing the current disturbance level of each frame pair with the switching parameter optimized threshold level for making the decision on which version of the different function to use.

According to an embodiment, said pre-processing is performed according to a first optimized pre-process and a second optimized pre-process such as to optimize differently for disturbances having a disturbance level below or above said switching parameter optimized threshold level; said providing of said difference functions comprises providing a first difference function from said first optimized pre-process optimized for disturbances below said switching parameter optimized threshold level, and providing a second difference function from said second optimized pre-process optimized for disturbances equal to or above said switching parameter optimized threshold level; and said step of compensating is performed on either said first difference function or said second difference function dependent on whether an actual disturbance level is above or below said threshold. Thus according to the invention the POLQA threshold disturbance level, used in the switching between the two difference functions, is compensated for the level of the degraded signal using a switching parameter. In a preferred implementation the threshold disturbance level is multiplied by a power ratio of the degraded and reference power leading to a switching parameter optimized threshold level.

The present invention may be applied to quality assessment algorithms such as POLQA or PESQ, or its predecessor PSQM. These algorithms are particularly developed to evaluate degraded speech signals. Within POLQA (perceptual objective listening quality assessment algorithm), the latest quality assessment algorithm which is presently under development, the reference speech signal and the degraded speech signal are both represented at least in terms of pitch and loudness.

According to a second aspect, the invention is directed to a computer program product comprising a computer executable code for performing a method as described above when executed by a computer.

According to a third aspect, the invention is directed to an apparatus for performing a method according to the first aspect of the invention, for evaluating intelligibility of a degraded speech signal, comprising: a receiving unit for receiving said degraded speech signal from an audio transmission system conveying a reference speech signal, and for receiving said reference speech signal; a sampling unit for sampling of said reference speech signal into a plurality of reference signal frames, and for sampling of said degraded speech signal into a plurality of degraded signal frames; a processing unit for forming frame pairs by associating each reference signal frame with a corresponding degraded signal frame, for pre-processing each reference signal frame and each degraded signal frame, and for providing for each frame pair one or more difference functions representing a difference between said degraded and said reference signal frame; a selector for selecting at least one of said difference functions, said selector being arranged for comparing a disturbance level of said degraded signal with a threshold disturbance level for performing said selection, a compensator unit for compensating said at least one of said difference functions for one or more disturbance types, such as to provide for each frame pair one or more disturbance density functions adapted to a human auditory perception model;

and wherein said processing unit is further arranged for deriving from said disturbance density functions of a plurality of frame pairs an overall quality parameter being at least indicative of said intelligibility of said degraded speech signal; wherein said processing unit is further arranged for determining at least one switching parameter indicative of an audio power level of said degraded signal, and providing said switching parameter to said selector for using said at least one switching parameter for determining or adapting said threshold disturbance level that is used in performing said selecting of said at least one of said difference functions for optimizing said method for audio power level conditions of said degraded signal for assessment of said intelligibility of said degraded speech signal for said evaluation.

BRIEF DESCRIPTION OF THE DRAWINGS

The present invention is further explained by means of specific embodiments, with reference to the enclosed drawings, wherein.

DETAILED DESCRIPTION

POLQA Perceptual Model

The basic approach of POLQA (ITU-T rec. P.863) is the same as used in PESQ (ITU-T rec. P.862), i.e. a reference input and degraded output speech signal are mapped onto an internal representation using a model of human perception. The difference between the two internal representations is used by a cognitive model to predict the perceived speech quality of the degraded signal. An important new idea implemented in POLQA is the idealization approach which removes low levels of noise in the reference input signal and optimizes the timbre. Further major changes in the perceptual model include the modelling of the impact of play back level on the perceived quality and a major split in the processing of low and high levels of distortion.

Figure 1:
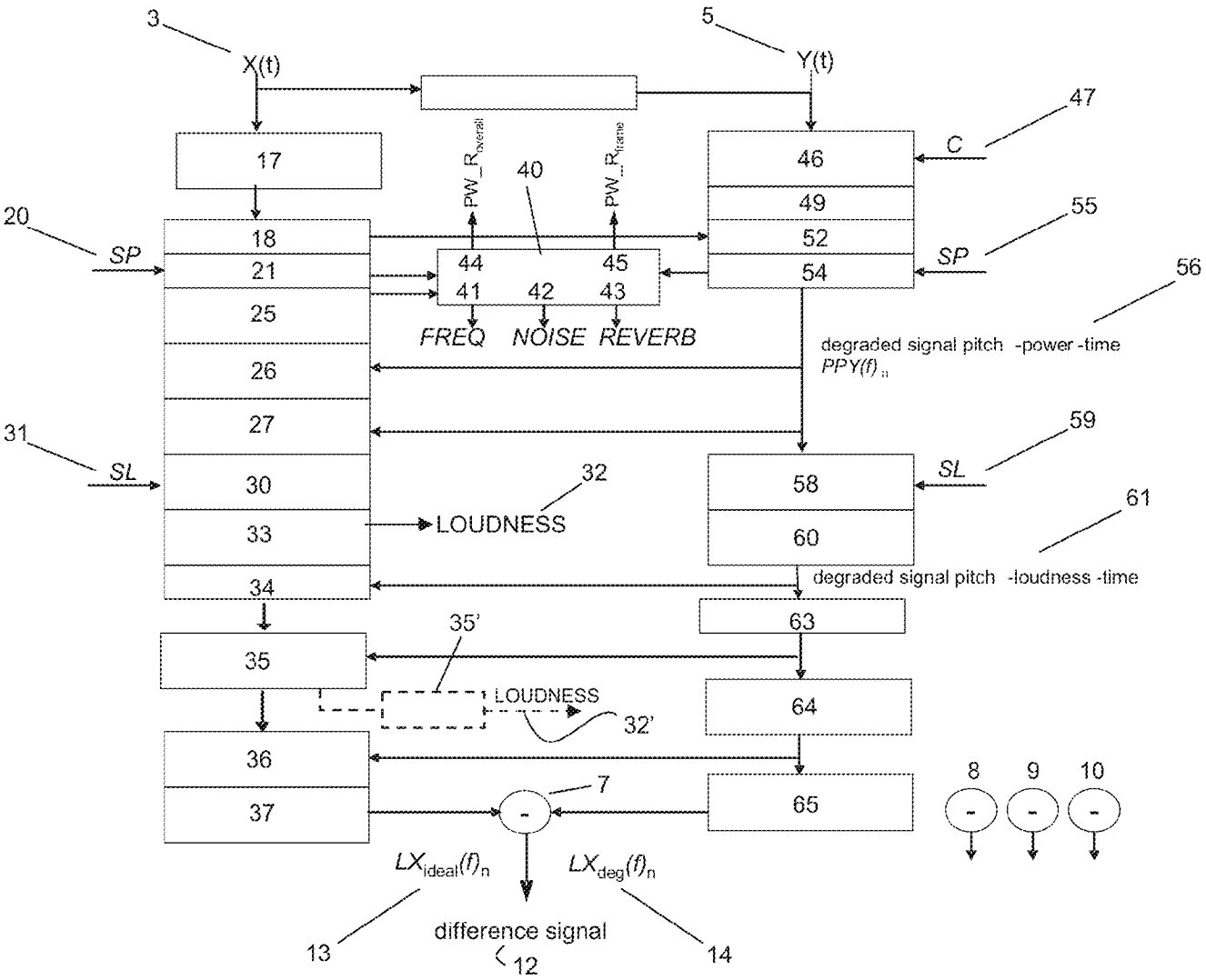
FIG. 1 provides an overview of the first part of the POLQA perceptual model in an embodiment in accordance with the invention.

An overview of the perceptual model used in POLQA is given in FIG. 1 through 4. FIG. 1 provides the first part of the perceptual model used in the calculation of the internal representation of the reference input signal X(t) 3 and the degraded output signal Y(t) 5. Both are scaled 17, 46 and the internal representations 13, 14 in terms of pitch-loudness-time are calculated in a number of steps described below, after which a difference function 12 is calculated, indicated in FIG. 1 with difference calculation operator 7. Two different flavours of the perceptual difference function are calculated, one for the overall disturbance introduced by the system using operators 7 and 8 under test and one for the added parts of the disturbance using operators 9 and 10. This models the asymmetry in impact between degradations caused by leaving out time-frequency components from the reference signal as compared to degradations caused by the introduction of new time-frequency components. In POLQA both flavours are calculated in two different approaches, one focussed on the normal range of degradations and one focussed on loud degradations resulting in four difference function calculations 7, 8, 9 and 10 indicated in FIG. 1.

Figure 2:
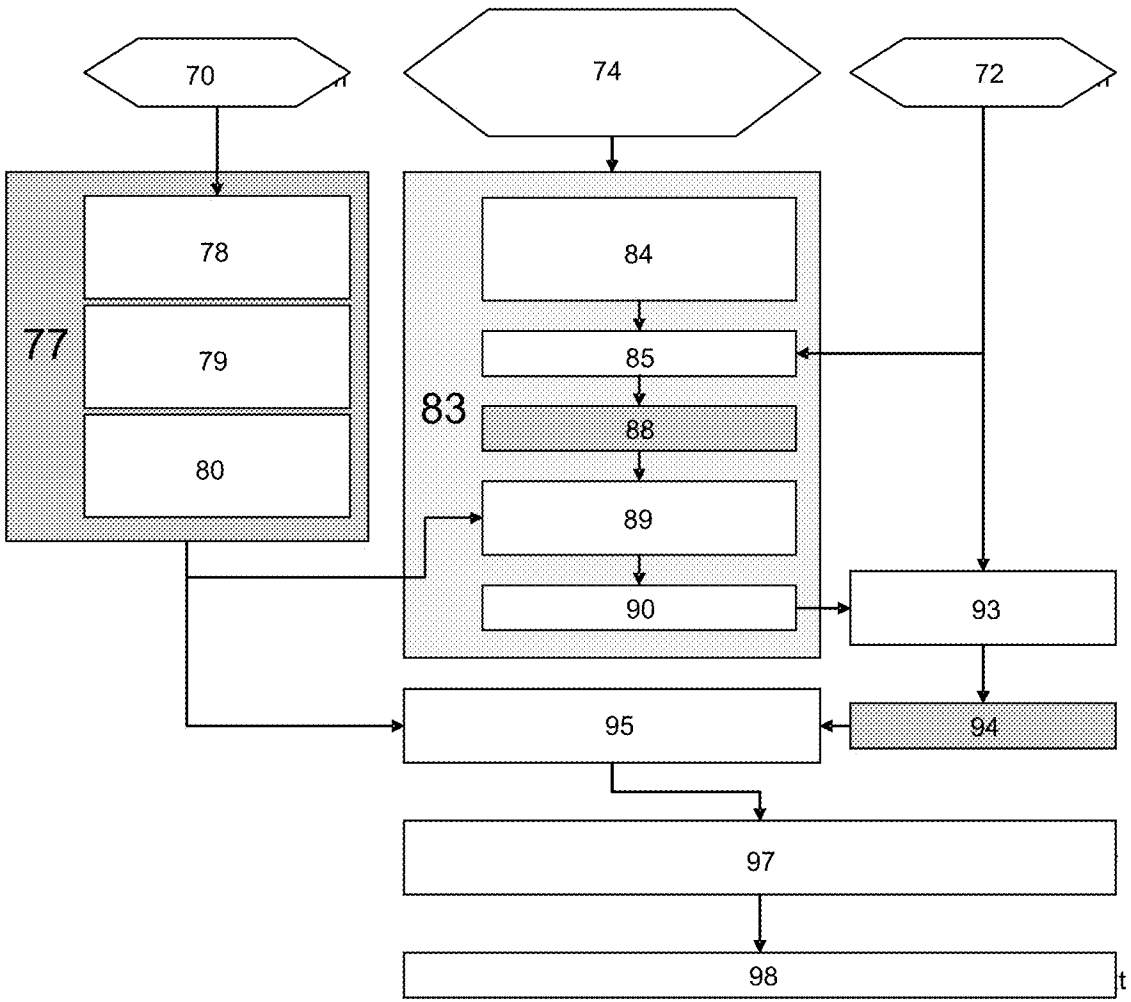
FIG. 2 provides an illustrative overview of the frequency alignment used in the POLQA perceptual model in an embodiment in accordance with the invention.

For degraded output signals with frequency domain warping 49 an align algorithm 52 is used given in FIG. 2. The final processing for getting the MOS-LQO scores is given in FIG. 3 and FIG. 4.

POLQA starts with the calculation of some basic constant settings after which the pitch power densities (power as function of time and frequency) of reference and degraded are derived from the time and frequency aligned time signals. From the pitch power densities the internal representations of reference and degraded are derived in a number of steps. Furthermore these densities are also used to derive 40 the first three POLQA quality indicators for frequency response distortions 41 (FREQ), additive noise 42 (NOISE) and room reverberations 43 (REVERB). These three quality indicators 41, 42 and 43 are calculated separately from the main disturbance indicator in order to allow a balanced impact analysis over a large range of different distortion types. These indicators can also be used for a more detailed analysis of the type of degradations that were found in the speech signal using a degradation decomposition approach. In accordance with the invention, in addition to the above indicators, also an overall power ratio and a per frame power ratio is determined between said degraded signal and said reference signal. These indicators are used for switching between various variants of the difference function as will be explained further below.

As stated four different variants of the internal representations of reference and degraded are calculated in 7, 8, 9 and 10; two variants focussed on the disturbances for normal and big distortions, and two focussed on the added disturbances for normal and big distortions. These four different variants 7, 8, 9 and 10 are the inputs to the calculation of the final disturbance densities.

The internal representations of the reference 3 are referred to as ideal representations because low levels of noise in the reference are removed (step 33) and timbre distortions as found in the degraded signal that may have resulted from a non optimal timbre of the original reference recordings are partially compensated for (step 35).

The four different variants of the ideal and degraded internal representations calculated using operators 7, 8, 9 and 10 are used to calculate two final disturbance densities 142 and 143, one representing the final disturbance 142 as a function of time and frequency focussed on the overall degradation and one representing the final disturbance 143 as a function of time and frequency but focussed on the processing of added degradation.

Figure 4:
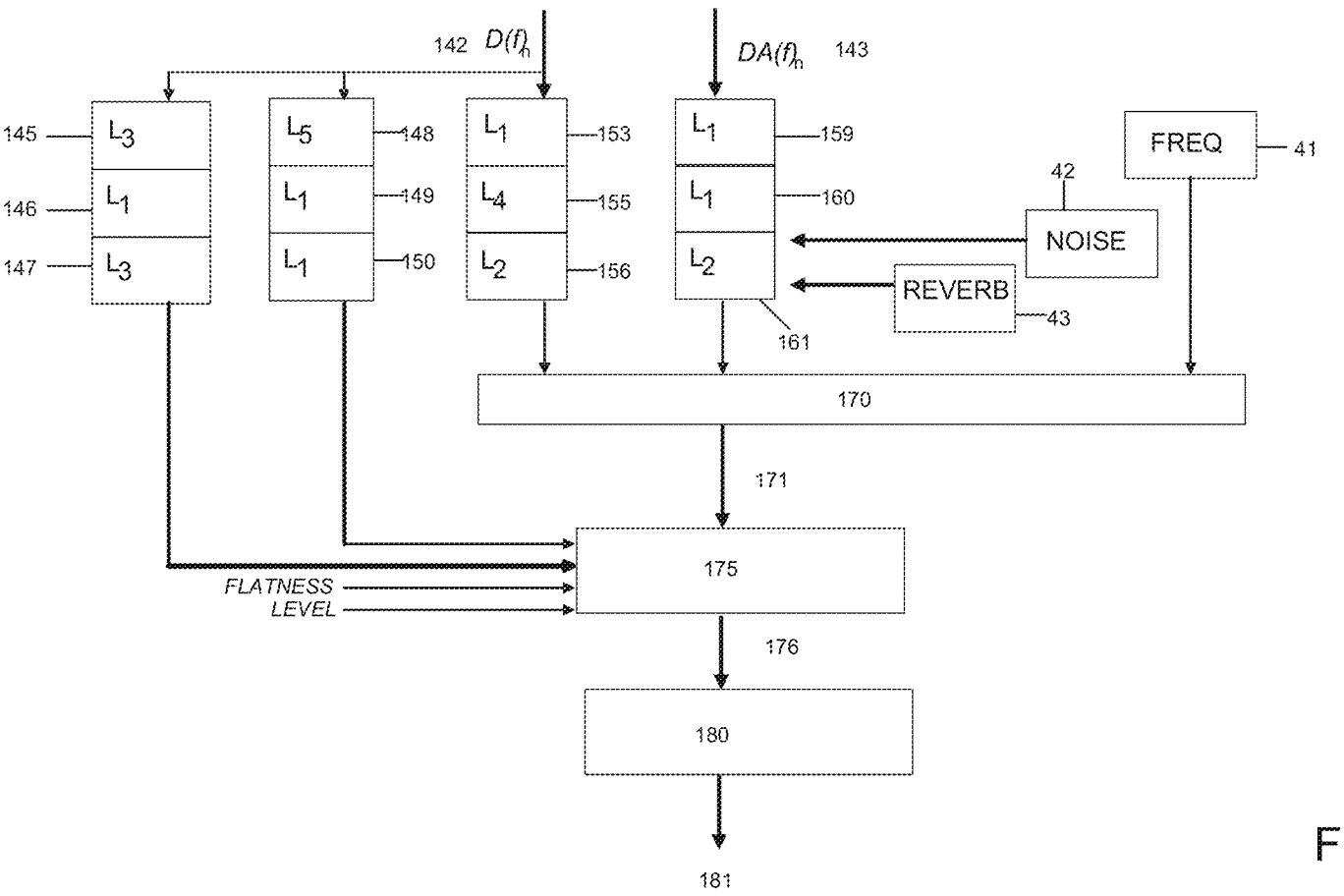
FIG. 4 is an overview of the third part of the POLQA perceptual model in an embodiment in accordance with the invention.

FIG. 4 gives an overview of the calculation of the MOS-LQO, the objective MOS score, from the two final disturbance densities 142 and 143 and the FREQ 41, NOISE 42, REVERB 43 indicators.

Pre-Computation of Constant Settings

FFT Window Size Depending on the Sample Frequency

POLQA operates on three different sample rates, 8, 16, and 48 kHz sampling for which the window size W is set to respectively 256, 512 and 2048 samples in order to match the time analysis window of the human auditory system. The overlap between successive frames is 50% using a Hann window. The power spectra—the sum of the squared real and squared imaginary parts of the complex FFT components—are stored in separate real valued arrays for both, the reference and the degraded signal. Phase information within a single frame is discarded in POLQA and all calculations are based on the power representations, only.

Start Stop Point Calculation

In subjective tests, noise will usually start before the beginning of the speech activity in the reference signal. However one can expect that leading steady state noise in a subjective test decreases the impact of steady state noise while in objective measurements that take into account leading noise it will increase the impact; therefore it is expected that omission of leading and trailing noises is the correct perceptual approach. Therefore, after having verified the expectation in the available training data, the start and stop points used in the POLQA processing are calculated from the beginning and end of the reference file. The sum of five successive absolute sample values (using the normal 16 bits PCM range −+32,000) must exceed 500 from the beginning and end of the original speech file in order for that position to be designated as the start or end. The interval between this start and end is defined as the active processing interval. Distortions outside this interval are ignored in the POLQA processing.

The Power and Loudness Scaling Factor SP and SL

For calibration of the FFT time to frequency transformation a sine wave with a frequency of 1000 Hz and an amplitude of 40 dB SPL is generated, using a reference signal X(t) calibration towards 73 dB SPL. This sine wave is transformed to the frequency domain using a windowed FFT in steps 18 and 49 with a length determined by the sampling frequency for X(t) and Y(t) respectively. After converting the frequency axis to the Bark scale in 21 and 54 the peak amplitude of the resulting pitch power density is then normalized to a power value of $10^4$ by multiplication with a power scaling factor SP 20 and 55 for X(t) and Y(t) respectively.

The same 40 dB SPL reference tone is used to calibrate the psychoacoustic (Sone) loudness scale. After warping the intensity axis to a loudness scale using Zwicker's law the integral of the loudness density over the Bark frequency scale is normalized in 30 and 58 to 1 Sone using the loudness scaling factor SL 31 and 59 for X(t) and Y(t) respectively.

Scaling and Calculation of the Pitch Power Densities

The degraded signal Y(t) 5 is multiplied 46 by the calibration factor C 47, that takes care of the mapping from dB overload in the digital domain to dB SPL in the acoustic domain, and then transformed 49 to the time-frequency domain with 50% overlapping FFT frames. The reference signal X(t) 3 is scaled 17 towards a predefined fixed optimal level of about 73 dB SPL equivalent before it's transformed 18 to the time-frequency domain. This calibration procedure is fundamentally different from the one used in PESQ where both the degraded and reference are scaled towards predefined fixed optimal level. PESQ pre-supposes that all play out is carried out at the same optimal playback level while in the POLQA subjective tests levels between 20 dB to +6 to relative to the optimal level are used. In the POLQA perceptual model one can thus not use a scaling towards a predefined fixed optimal level.

After the level scaling the reference and degraded signal are transformed 18, 49 to the time-frequency domain using the windowed FFT approach. For files where the frequency axis of the degraded signal is warped when compared to the reference signal a dewarping in the frequency domain is carried out on the FFT frames. In the first step of this dewarping both the reference and degraded FFT power spectra are preprocessed to reduce the influence of both very narrow frequency response distortions, as well as overall spectral shape differences on the following calculations. The preprocessing 77 consists in performing a sliding window average in 78 over both power spectra, taking the logarithm 79, and performing a sliding window normalization in 80. Next the pitches of the current reference and degraded frame are computed using a stochastic subharmonic pitch algorithm. The ratio 74 of the reference to degraded pitch ration is then used to determine (in step 84) a range of possible warping factors. If possible, this search range is extended by using the pitch ratios for the preceding and following frame pair.

The frequency align algorithm then iterates through the search range and warps 85 the degraded power spectrum with the warping factor of the current iteration, and processes 88 the warped power spectrum as described above. The correlation of the processed reference and processed warped degraded spectrum is then computed (in step 89) for bins below 1500 Hz. After complete iteration through the search range, the "best" (i.e. that resulted in the highest correlation) warping factor is retrieved in step 90. The correlation of the processed reference and best warped degraded spectra is then compared against the correlation of the original processed reference and degraded spectra. The "best" warping factor is then kept 97 if the correlation increases by a set threshold. If necessary, the warping factor is limited in 98 by a maximum relative change to the warping factor determined for the previous frame pair.

After the dewarping that may be necessary for aligning the frequency axis of reference and degraded, the frequency scale in Hz is warped in steps 21 and 54 towards the pitch scale in Bark reflecting that at low frequencies, the human hearing system has a finer frequency resolution than at high frequencies. This is implemented by binning FFT bands and summing the corresponding powers of the FFT bands with a normalization of the summed parts. The warping function that maps the frequency scale in Hertz to the pitch scale in Bark approximates the values given in the literature for this purpose, and known to the skilled reader. The resulting reference and degraded signals are known as the pitch power densities $PPX(f)_n$ (not indicated in FIG. 1) and $PPY(f)_n$ 56 with f the frequency in Bark and the index n representing the frame index.

Computation of the Speech Active, Silent and Super Silent Frames (Step 25)

POLQA operates on three classes of frames, which are distinguished in step 25:

- speech active frames where the frame level of the reference signal is above a level that is about 20 dB below the average,
- silent frames where the frame level of the reference signal is below a level that is about 20 dB below the average and
- super silent frames where the frame level of the reference signal is below a level that is about 35 dB below the average level.

Calculation of the Frequency, Noise and Reverb Indicators and Determination of Audio Power Ratios In step 40, a number of parameters and indicator for later use in the evaluation process and system are determined from either the reference signal, or the degraded signal, or both. Although these parameter are calculated, according to this embodiment, in step 40, they may be determined at a different stage in the process and the invention is not limited to determination in step 40 of any of the indicators mentioned below, in particular the indicators $PW_R_{overall}$ 44 and $PW_R_{frame}$ 45 described below.

In accordance with the invention, the overall power ratio of the audio power of the degraded signal compared with the audio power of the reference signal is determined in step 40, and yields the overall audio power ratio indicator 44 referred to in FIG. 1 as $PW_R_{overall}$. This indicator is used in accordance with the present invention to include the overall volume or audio power of the degraded signal in the POLQA model, such as to evaluate the impact of different kind of disturbances differently dependent on whether the degraded signal is loud or weak. As may be appreciated, human perception also values specific types of disturbances differently for weak and for loud audio signals. Although step 40, as described here, determines the overall audio power ratio 44 between degraded and reference signal, it may be appreciated that the overall power of the reference signal is usually kept at a constant level, thus indicator 44 may arithmetically also be interpreted as a direct measure of the power of the degraded signal, multiplied with a constant. For the present embodiment however, $PW_R_{overall}$ switching parameter 44 may be determined as follows:

$$PW_R_{overall}=(\mathrm{POWER}_{overall,\mathrm{degraded}}+\delta)/(\mathrm{POWER}_{overall,reference}+\delta))p,$$

wherein $\mathrm{POWER}_{overall,\ degraded}$ is the overall audio power of the degraded signal, $\mathrm{POWER}_{overall,\ reference}$ is the overall audio power of the reference signal, p a compression power and δ a correction factor required for preventing the value of $PW_R_{overall}$ to become too large to be practical and for taking specifics of human perception into account.

In addition in the present embodiment, and an optional but preferred improvement to the invention, step 40 calculates the audio power ration per frame between the degraded signal and the reference signal. This is included such as to take into account the effect of any (unexpected) variations in the audio power of the degraded signal (e.g. caused by a disfunctioning amplifier). Although $PW_R_{frame}$ indicator 45 is calculated per frame, the manner of calculating this switching parameter is similar to $PW_R_{overall}$ indicator 44 described above, being:

$$PW_R_{frame}=((\mathrm{POWER}_{frame,degraded}+\delta)/(\mathrm{POWER}_{frame,reference}+\delta))p,$$

wherein $\mathrm{POWER}_{frame}$, degraded is the overall audio power of the degraded signal, $\mathrm{POWER}_{frame}$, reference is the overall audio power of the reference signal, p a compression power and δ a correction factor required for preventing the value of $PW_R_{frame}$ to become too large to be practical and for taking specifics of human perception into account. Although as suggested here p and δ are the same for overall calculation and the calculation per frame, the skilled person may appreciate that different values for p and 6 may be used for each of the calculations. This $PW_R_{overall}$, $PW_R_{frame}$, or a combination, is then used to modify the threshold disturbance level that is used in the switching between the four different difference functions as provided in the standard POLQA implementation. The modified threshold disturbance level represents the switching parameter optimized threshold level.

The global impact of frequency response distortions, noise and room reverberations is separately quantified in step 40. For the impact of overall global frequency response distortions, an indicator 41 is calculated from the average spectra of reference and degraded signals. In order to make the estimate of the impact for frequency response distortions independent of additive noise, the average noise spectrum density of the degraded over the silent frames of the reference signal is subtracted from the pitch loudness density of the degraded signal. The resulting pitch loudness density of the degraded and the pitch loudness density of the reference are then averaged in each Bark band over all speech active frames for the reference and degraded file. The difference in pitch loudness density between these two densities is then integrated over the pitch to derive the indicator 41 for quantifying the impact of frequency response distortions (FREQ).

For the impact of additive noise, an indicator 42 is calculated from the average spectrum of the degraded signal over the silent frames of the reference signal. The difference between the average pitch loudness density of the degraded over the silent frames and a zero reference pitch loudness density determines a noise loudness density function that quantifies the impact of additive noise. This noise loudness density function is then integrated over the pitch to derive an average noise impact indicator 42 (NOISE). This indicator 42 is thus calculated from an ideal silence so that a transparent chain that is measured using a noisy reference signal will thus not provide the maximum MOS score in the final POLQA end-to-end speech quality measurement.

For the impact of room reverberations, the energy over time function (ETC) is calculated from the reference and degraded time series. The ETC represents the envelope of the impulse response. In a first step the loudest reflection is calculated by simply determining the maximum value of the ETC curve after the direct sound. In the POLQA model direct sound is defined as all sounds that arrive within 60 ms. Next a second loudest reflection is determined over the interval without the direct sound and without taking into account reflections that arrive within 100 ms from the loudest reflection. Then the third loudest reflection is determined over the interval without the direct sound and without taking into account reflections that arrive within 100 ms from the loudest and second loudest reflection. The energies of the three loudest reflections are then combined into a single reverb indicator 43 (REVERB).

Global and Local Scaling of the Reference Signal Towards the Degraded Signal (Step 26)

The reference signal is now in accordance with step 17 at the internal ideal level, i.e. about 73 dB SPL equivalent, while the degraded signal is represented at a level that coincides with the playback level as a result of 46. Before a comparison is made between the reference and degraded signal the global level difference is compensated in step 26. Furthermore small changes in local level are partially compensated to account for the fact that small enough level variations are not noticeable to subjects in a listening-only situation. The global level equalization 26 is carried out on the basis of the average power of reference and degraded signal using the frequency components between 400 and 3500 Hz. The reference signal is globally scaled towards the degraded signal and the impact of the global playback level difference is thus maintained at this stage of processing. Similarly, for slowly varying gain distortions a local scaling is carried out for level changes up to about 3 dB using the full bandwidth of both the reference and degraded speech file.

Partial Compensation of the Original Pitch Power Density for Linear Frequency Response Distortions (Step 27)

In order to correctly model the impact of linear frequency response distortions, induced by filtering in the system under test, a partial compensation approach is used in step 27. To model the imperceptibility of moderate linear frequency response distortions in the subjective tests, the reference signal is partially filtered with the transfer characteristics of the system under test. This is carried out by calculating the average power spectrum of the original and degraded pitch power densities over all speech active frames. Per Bark bin, a partial compensation factor is calculated 27 from the ratio of the degraded spectrum to the original spectrum.

Figures 5A, 5B, 5C:
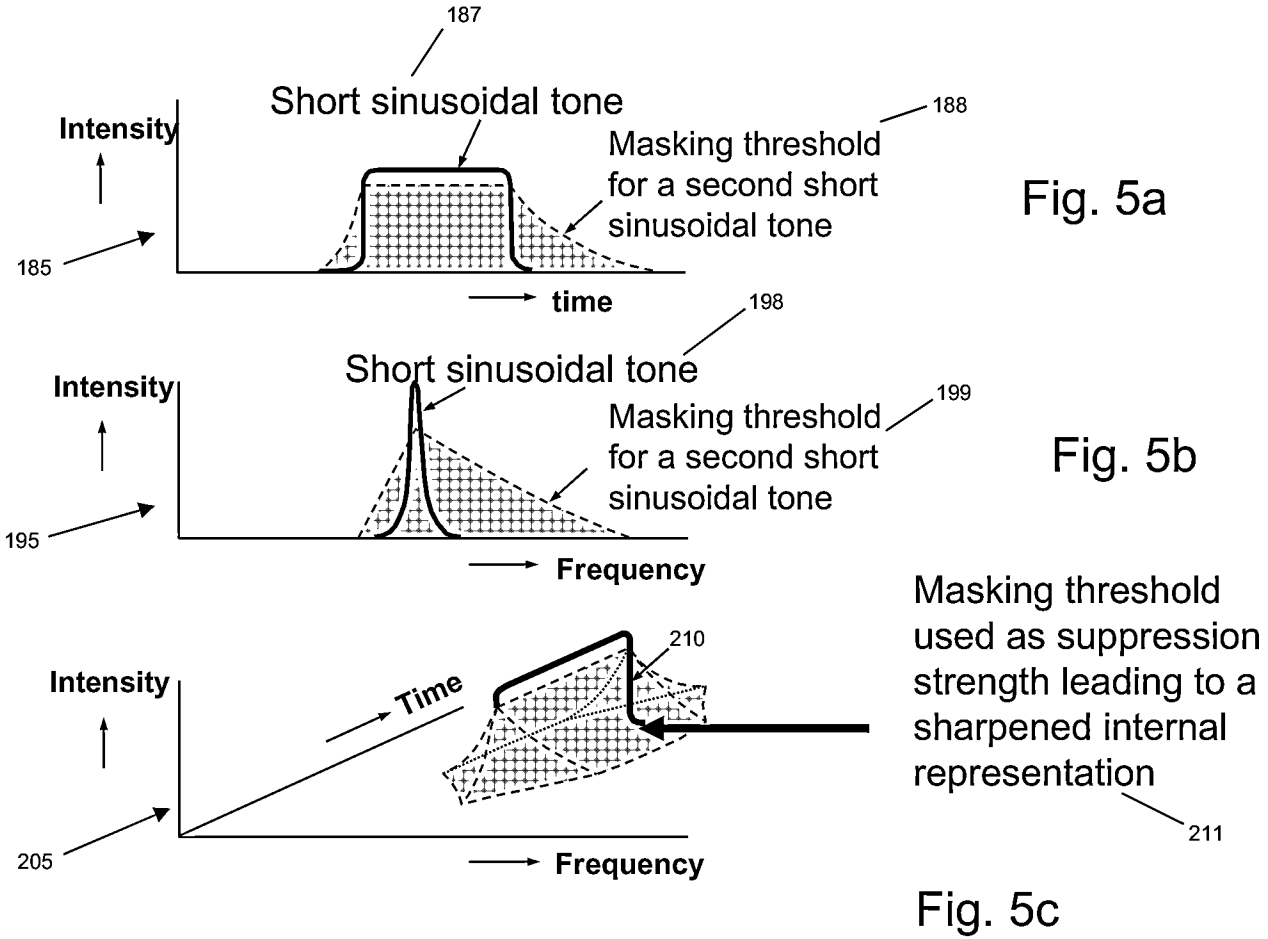
FIG. 5 is a schematic overview of a masking approach used in the POLQA model in an embodiment in accordance with the invention.

Modelling of Masking Effects, Calculation of the Pitch Loudness Density Excitation Masking is modelled in steps 30 and 58 by calculating a smeared representation of the pitch power densities. Both time and frequency domain smearing are taken into account in accordance with the principles illustrated in FIG. 5*a* through 5*c*. The time-frequency domain smearing uses the convolution approach. From this smeared representation, the representations of the reference and degraded pitch power density are re-calculated suppressing low amplitude time-frequency components, which are partially masked by loud components in the neighborhood in the time-frequency plane. This suppression is implemented in two different manners, a subtraction of the smeared representation from the non-smeared representation and a division of the non-smeared representation by the smeared representation. The resulting, sharpened, representations of the pitch power density are then transformed to pitch loudness density representations using a modified version of Zwicker's power law:

$$LX(f)_n = SL * \left(\frac{P_0(f)}{0.5}\right)^{0.22*f_B*P_{fn}} * \left[\left(0.5 + 0.5\frac{PPX(f)_n}{P_0(f)}\right)^{0.22*f_B+P_n} - 1\right]$$

with SL the loudness scaling factor, P0(f) the absolute hearing threshold, fB and Pfn a frequency and level dependent correction defined by:

$$f_B = -0.03*f + 1.06 \text{ for } f < 2.0 \text{ Bark}$$

$$f_B = 1.0 \text{ for } 2.0 \le f \le 22 \text{ Bark}$$

$$f_B = -0.2*(f - 22.0) + 1.0 \text{ for } f > 22.0 \text{ Bark}$$

$$P_{fn} = (PPX(f)_n + 600)^{0.008}$$

with f representing the frequency in Bark, $PPX(f)_n$ the pitch power density in frequency time cell f, n. The resulting two dimensional arrays $LX(f)_n$ and $LY(f)_n$ are called pitch loudness densities, at the output of step 30 for the reference signal X(t) and step 58 for the degraded signal Y(t) respectively.

Global Low Level Noise Suppression in Reference and Degraded Signals

Low levels of noise in the reference signal, which are not affected by the system under test (e.g., a transparent system) will be attributed to the system under test by subjects due to the absolute category rating test procedure. These low levels of noise thus have to be suppressed in the calculation of the internal representation of the reference signal. This "idealization process" is carried out in step 33 by calculating the average steady state noise loudness density of the reference signal $LX(f)_n$ over the super silent frames as a function of pitch. This average noise loudness density is then partially subtracted from all pitch loudness density frames of the reference signal. The result is an idealized internal representation of the reference signal, at the output of step 33.

Steady state noise that is audible in the degraded signal has a lower impact than non-steady state noise. This holds for all levels of noise and the impact of this effect can be modelled by partially removing steady state noise from the degraded signal. This is carried out in step 60 by calculating the average steady state noise loudness density of the degraded signal $LY(f)_n$ frames for which the corresponding frame of the reference signal is classified as super silent, as a function of pitch. This average noise loudness density is then partially subtracted from all pitch loudness density frames of the degraded signal. The partial compensation uses a different strategy for low and high levels of noise. For low levels of noise the compensation is only marginal while the suppression that is used becomes more aggressive for loud additive noise. The result is an internal representation 61 of the degraded signal with an additive noise that is adapted to the subjective impact as observed in listening tests using an idealized noise free representation of the reference signal.

In the present embodiment, in step 33 above, in addition to performing the global low level noise suppression, also the LOUDNESS indicator 32 is determined for each of the reference signal frames. The LOUDNESS indicator or LOUDNESS value will be used to determine a loudness dependent weighting factor for weighing specific types of distortions. The weighing itself may be implemented in steps 125 and 125' for the four representations of distortions provided by operators 7, 8, 9 and 10, upon providing the final disturbance densities 142 and 143.

Here, the loudness level indicator has been determined in step 33, but one may appreciate that the loudness level indicator may be determined for each reference signal frame in another part of the method. In step 33 determining the loudness level indicator is possible due to the fact that already the average steady state noise loud density is determined for reference signal $LX(f)_n$ over the super silent frames, which are then used in the construction of the noise free reference signal for all reference frames. However, although it is possible to implement this in step 33, it is not the most preferred manner of implementation.

Alternatively, the loudness level indicator (LOUDNESS) may be taken from the reference signal in an additional step following step 35. This additional step is also indicated in FIG. 1 as a dotted box 35' with dotted line output (LOUDNESS) 32'. If implemented there in step 35', it is no longer necessary to take the loudness level indicator from step 33, as the skilled reader may appreciate.

Local Scaling of the Distorted Pitch Loudness Density for Time-Varying Gain Between Degraded and Reference Signal (Steps 34 and 63)

Slow variations in gain are inaudible and small changes are already compensated for in the calculation of the reference signal representation. The remaining compensation necessary before the correct internal representation can be calculated is carried out in two steps; first the reference is compensated in step 34 for signal levels where the degraded signal loudness is less than the reference signal loudness, and second the degraded is compensated in step 63 for signal levels where the reference signal loudness is less than the degraded signal loudness.

The first compensation 34 scales the reference signal towards a lower level for parts of the signal where the degraded shows a severe loss of signal such as in time clipping situations. The scaling is such that the remaining difference between reference and degraded represents the impact of time clips on the local perceived speech quality. Parts where the reference signal loudness is less than the degraded signal loudness are not compensated and thus additive noise and loud clicks are not compensated in this first step.

The second compensation 63 scales the degraded signal towards a lower level for parts of the signal where the degraded signal shows clicks and for parts of the signal where there is noise in the silent intervals. The scaling is such that the remaining difference between reference and degraded represents the impact of clicks and slowly changing additive noise on the local perceived speech quality. While clicks are compensated in both the silent and speech active parts, the noise is compensated only in the silent parts.

Partial Compensation of the Original Pitch Loudness Density for Linear Frequency Response Distortions (Step 35)

Imperceptible linear frequency response distortions were already compensated by partially filtering the reference signal in the pitch power density domain in step 27. In order to further correct for the fact that linear distortions are less objectionable than non-linear distortions, the reference signal is now partially filtered in step 35 in the pitch loudness domain. This is carried out by calculating the average loudness spectrum of the original and degraded pitch loudness densities over all speech active frames. Per Bark bin, a partial compensation factor is calculated from the ratio of the degraded loudness spectrum to the original loudness spectrum. This partial compensation factor is used to filter the reference signal with smoothed, lower amplitude, version of the frequency response of the system under test. After this filtering, the difference between the reference and degraded pitch loudness densities that result from linear frequency response distortions is diminished to a level that represents the impact of linear frequency response distortions on the perceived speech quality.

Final Scaling and Noise Suppression of the Pitch Loudness Densities

Up to this point, all calculations on the signals are carried out on the playback level as used in the subjective experiment. For low playback levels, this will result in a low difference between reference and degraded pitch loudness densities and in general in a far too optimistic estimation of the listening speech quality. In order to compensate for this effect the degraded signal is now scaled towards a "virtual" fixed internal level in step 64. After this scaling, the reference signal is scaled in step 36 towards the degraded signal level and both the reference and degraded signal are now ready for a final noise suppression operation in 37 and 65 respectively. This noise suppression takes care of the last parts of the steady state noise levels in the loudness domain that still have a too big impact on the speech quality calculation. The resulting signals 13 and 14 are now in the perceptual relevant internal representation domain and from the ideal pitch-loudness-time $LX_{idea}(f)_n$ 13 and degraded pitch-loudness-time $LY_{deg}(f)_n$ 14 functions the disturbance densities 142 and 143 can be calculated. Four different variants of the ideal and degraded pitch-loudness-time functions are calculated in 7, 8, 9 and 10, two variants (7 and 8) focussed on the disturbances for normal and big distortions, and two (9 and 10) focussed on the added disturbances for normal and big distortions.

Calculation of the Final Disturbance Densities

Two different flavours of the disturbance densities 142 and 143 are calculated. The first one, the normal disturbance density, is based on difference functions 7 and 8, i.e. the difference between the ideal pitch-loudness-time $LX_{ideal}(f)_n$ and degraded pitch-loudness-time function $LY_{deg}(f)_n$. The second one, the added disturbance density, is derived from difference functions 9 and 10, i.e. from the ideal pitch-loudness-time and the degraded pitch-loudness-time function using versions that are optimized with regard to introduced (i.e. added) degradations. In this added disturbance calculation, signal parts where the degraded power density is larger than the reference power density are weighted with a factor dependent on the power ratio in each pitch-time cell, the asymmetry factor.

In order to be able to deal with a large range of distortions, it is also necessary to distinguish between loud (big) disturbances and weak (or normal) disturbances. Therefore, for distinguishing between normal and added disturbance and between weak and strong disturbances, four different versions of the pre-processing are to be carried out for providing the four difference functions 7, 8, 9 and 10. Two pre-processing steps focus on small to medium distortions and are optimized for assessing distortions of such a level in the evaluation of intelligibility, wherein one is optimized for normal disturbance and the other is optimized for added disturbance. Based on this processing, difference functions 7 and 9 are derived. Another two pre-processing steps are optimized for dealing with medium to loud distortions, wherein one is optimized for normal disturbance and the other is optimized for added disturbance. Based on this, difference functions 8 and 10 are derived. In FIG. 1, since the optimization is in the details of performing each of the steps while the steps itself and the order in which they are carried out is not different between the four pre-processing steps, the above is simply illustrated by the four difference operators 7, 8, 9, and 10 at the bottom of FIG. 1 without recasting of all details of the four pre-processing steps for reasons of clarity.

Having available each of the difference operators 7, 8, 9, and 10, it is then necessary to select the right difference operator to be used for further processing, such as to take into account the different types of disturbances correctly as optimized for the specific situation. This selection is performed by the selector 123, which performs a switching function in order to optimize the evaluation and adapt it as much as possible to real human perception. Primarily, in accordance with the present invention, this switching is performed based on the $PW_R_{overall}$ indicator 44 determined in step 40, which indicates the overall audio power ratio between the degraded and reference signal (i.e. effectively taking into account whether the degraded signal is a weak signal or a strong signal). A further improvement however may optionally be achieved by also taking into account the audio power ratio per frame between the degraded and reference signal. Whereas the overall audio power ratio provides information on how weak or strong the degraded signal is perceived, the audio power ratio per frame indicates takes in to account sudden changes in the power level of the degraded signal, for example caused by a badly functioning amplifier or appliance, a bad connection on the line, some switching issue in a node, an optical or electrical issue, or any other issue that may give rise to (sudden) variations in the received audio power of the degraded signal.

Figure 3:
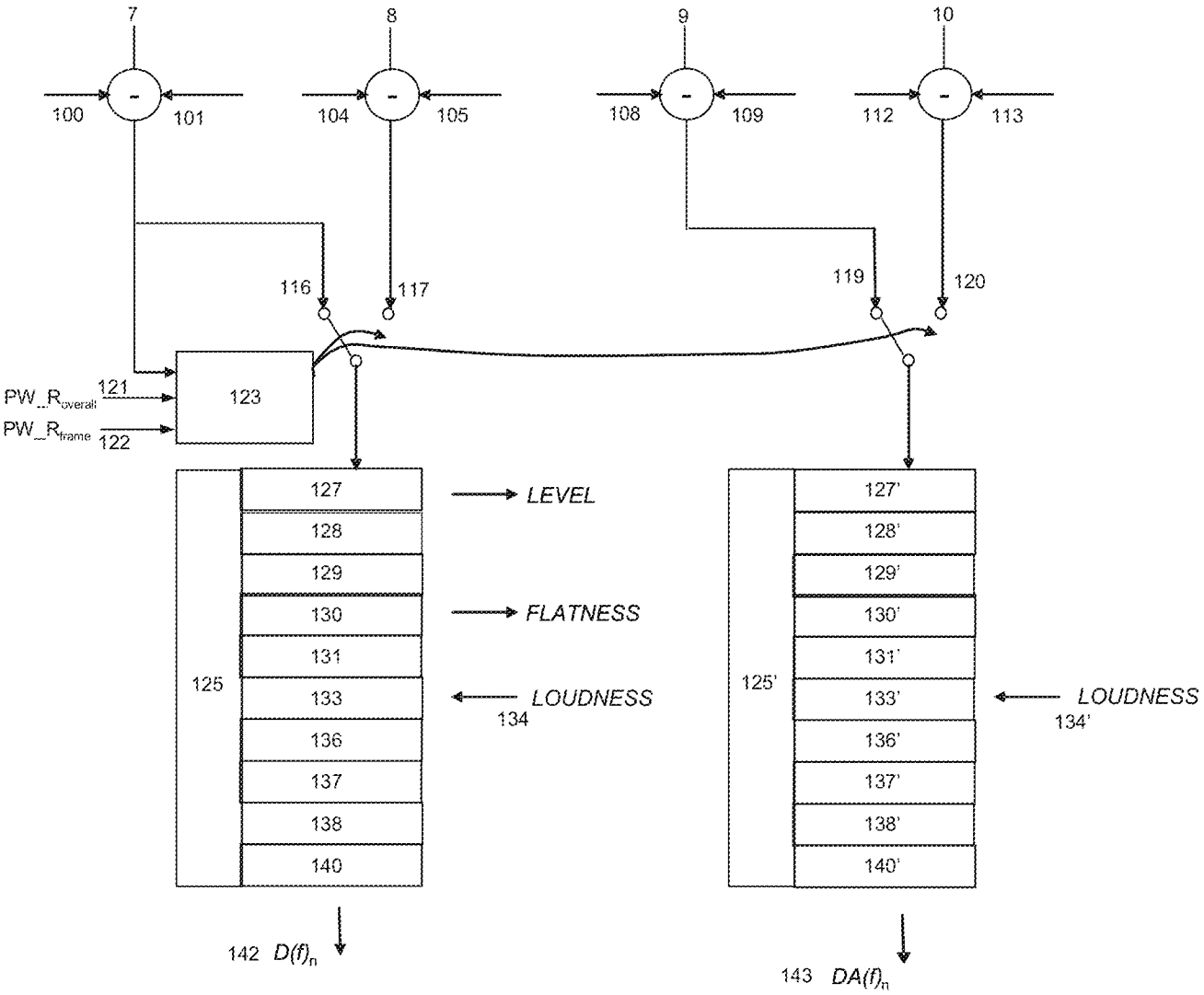
FIG. 3 provides an overview of the second part of the POLQA perceptual model, following on the first part illustrated in FIG. 1, in an embodiment in accordance with the invention.

As illustrated in FIG. 3, for both the normal (7 and 8) and the added disturbance (9 and 10), the switching between the small to medium and medium to big distortions is carried out in step 123 on the basis of the overall and per frame audio power ratios $PW_R_{overall}$ 44 and $PW_R_{frame}$ 45 between the degraded and reference signal provided in input 121 and 122 respectively, and a first estimation of the disturbance level from the normal disturbance 7 focussed on small to medium level of distortions. This processing approach leads to the necessity of calculating four different ideal pitch-loudness-time functions 100, 104, 108, and 112 and four different degraded pitch-loudness-time functions 101, 105, 109, and 113 in order to be able to calculate a single disturbance 142 and a single added disturbance function 143 which have been compensated in steps 125 and 125' for a number of different types of severe amounts of specific distortions (sub-steps 127-140 (normal) and 127'-140' (added)).

Severe deviations of the optimal listening level are quantified in 127 and 127' by an indicator directly derived from the signal level of the degraded signal. This global indicator (LEVEL) is also used in the calculation of the MOS-LQO.

Severe distortions introduced by frame repeats are quantified 128 and 128' by an indicator derived from a comparison of the correlation of consecutive frames of the reference signal with the correlation of consecutive frames of the degraded signal.

Severe deviations from the optimal "ideal" timbre of the degraded signal are quantified 129 and 129' by an indicator derived from the ratio of the upper frequency band loudness and the lower frequency band loudness. Compensations are carried out per frame and on a global level. This compensation calculates the power in the lower and upper Bark bands (below 12 and above 7 Bark, i.e. using a 5 Bark overlap) of the degraded signal and "punishes" any severe imbalance irrespective of the fact that this could be the result of an incorrect voice timbre of the reference speech file. Note that a transparent chain using poorly recorded reference signals, containing too much noise and/or an incorrect voice timbre, will thus not provide the maximum MOS score in a POLQA end-to-end speech quality measurement. This compensation also has an impact when measuring the quality of devices which are transparent. When reference signals are used that show a significant deviation from the optimal "ideal" timbre the system under test will be judged as non-transparent even if the system does not introduce any degradation into the reference signal.

The impact of severe peaks in the disturbance is quantified in 130 and 130' in the FLATNESS indicator which is also used in the calculation of the MOS-LQO.

Severe noise level variations which focus the attention of subjects towards the noise are quantified in 131 and 131' by a noise contrast indicator derived from the silent parts of the reference signal.

In steps 133 and 133', a weighting operation is performed for weighing disturbances dependent on whether or not they coincide with the actual spoken voice. In order to assess the intelligibility of the degraded signal, disturbances which are perceived during silent periods are not considered to be as detrimental as disturbances which are perceived during actual spoken voice. Therefore, based on the LOUDNESS indicator determined in step 33 (or step 35' in the alternative embodiment) from the reference signal, a weighting value is determined for weighing any disturbances. The weighting value is used for weighing the difference function (i.e. disturbances) for incorporating the impact of the disturbances on the intelligibility of the degraded speech signal into the evaluation. In particular, since the weighting value is determined based on the LOUDNESS indicator, the weighting value may be represented by a loudness dependent function. In the present embodiment, the loudness dependent weighting value is determined by comparing the loudness value to a threshold. If the loudness indicator exceeds the threshold the perceived disturbances are fully taken in consideration when performing the evaluation. On the other hand, if the loudness value is smaller than the threshold, the weighting value is made dependent on the loudness level indicator; i.e. in the present embodiment the weighting value is equal to the loudness level indicator (in the regime where LOUDNESS is below the threshold). The advantage is that for weak parts of the speech signal, e.g. at the ends of spoken words just before a pause or silence, disturbances are taken partially into account as being detrimental to the intelligibility.

As an example, one may appreciate that a certain amount of noise perceived while speaking out the letter 'f' at the end of a word, may cause a listener to perceive this as being the letter 's'. This could be detrimental to the intelligibility. On the other hand, the skilled person may appreciate that it is also possible (in a different embodiment) to simply disregard any noise during silence or pauses, by turning the weighting value to zero when the loudness value is below the above mentioned threshold. The method of weighing the disturbance in a loudness dependent manner is further described below in relation to FIG. 6.

Severe jumps in the alignment are detected in the alignment and the impact is quantified in steps 136 and 136' by a compensation factor.

Finally the disturbance and added disturbance densities are clipped in 137 and 137' to a maximum level and the variance of the disturbance 138 and 138' and the jumps 140 and 140' in the loudness are used to compensate for specific time structures of the disturbances.

This yields the final disturbance density $D(f)_n$ 142 for regular disturbance and the final disturbance density $DA(f)_n$ 143 for added disturbance.

Aggregation of the Disturbance over Pitch, Spurts and Time, Mapping to Intermediate MOS Score The final disturbance $D(f)_n$ 142 and added disturbance $DA(f)_n$ densities 143 are integrated per frame over the pitch axis resulting in two different disturbances per frame, one derived from the disturbance and one derived from the added disturbance, using an $L_1$ integration 153 and 159 (see FIG. 4):

$$D_n = \sum_{f=1,\ldots\ Number\ of\ Barkbands} |D(f)_n| W_f$$

$$DA_n = \sum_{f=1,\ldots\ Number\ of\ Barkbands} |DA(f)_n| W_f$$

with $W_f$ a series of constants proportional to the width of the Bark bins.

Next these two disturbances per frame are averaged over speech spurts of six consecutive frames with an $L_4$ 155 and an $L_1$ 160 weighting for the disturbance and for the added disturbance, respectively.

$$DS_n = \sqrt[4]{\frac{1}{6} \sum_{m=n,\ldots\ n+6} D_m^4}$$

$$DAS_n = \frac{1}{6} \sum_{m=n,\ldots\ n+6} D_m$$

Finally a disturbance and an added disturbance are calculated per file from an $L_2$ 156 and 161 averaging over time:

$$D = \sqrt[2]{\frac{1}{numberOfFrames} \sum_{n=1,\ldots\ numberOfFrames} DAS_n^2}$$

$$DA = \sqrt[2]{\frac{1}{numberOfFrames} \sum_{n=1,\ldots\ numberOfFrames} DAS_n^2}$$

The added disturbance is compensated in step 161 for loud reverberations and loud additive noise using the REVERB 42 and NOISE 43 indicators. The two disturbances are then combined 170 with the frequency indicator 41 (FREQ) to derive an internal indicator that is linearized with a third order regression polynomial to get a MOS like intermediate indicator 171.

Computation of the Final POLQA MOS-LQO

The raw POLQA score is derived from the MOS like intermediate indicator using four different compensations all in step 175:

- two compensations for specific time-frequency characteristics of the disturbance, one calculated with an $L_{511}$ aggregation over frequency 148, spurts 149 and time 150, and one calculated with an $L_{313}$ aggregation over frequency 145, spurts 146 and time 147

- one compensation for very low presentation levels using the LEVEL indicator
- one compensation for big timbre distortions using the FLATNESS indicator The training of this mapping is carried out on a large set of degradations, including degradations that were not part of the POLQA benchmark. These raw MOS scores 176 are for the major part already linearized by the third order polynomial mapping used in the calculation of the MOS like intermediate indicator 171.

Finally the raw POLQA MOS scores 176 are mapped in 180 towards the MOS-LQO scores 181 using a third order polynomial that is optimized for the 62 databases as were available in the final stage of the POLQA standardization. In narrowband mode the maximum POLQA MOS-LQO score is 4.5 while in super-wideband mode this point lies at 4.75. An important consequence of the idealization process is that under some circumstances, when the reference signal contains noise or when the voice timbre is severely distorted, a transparent chain will not provide the maximum MOS score of 4.5 in narrowband mode or 4.75 in super-wideband mode.

Figure 6:
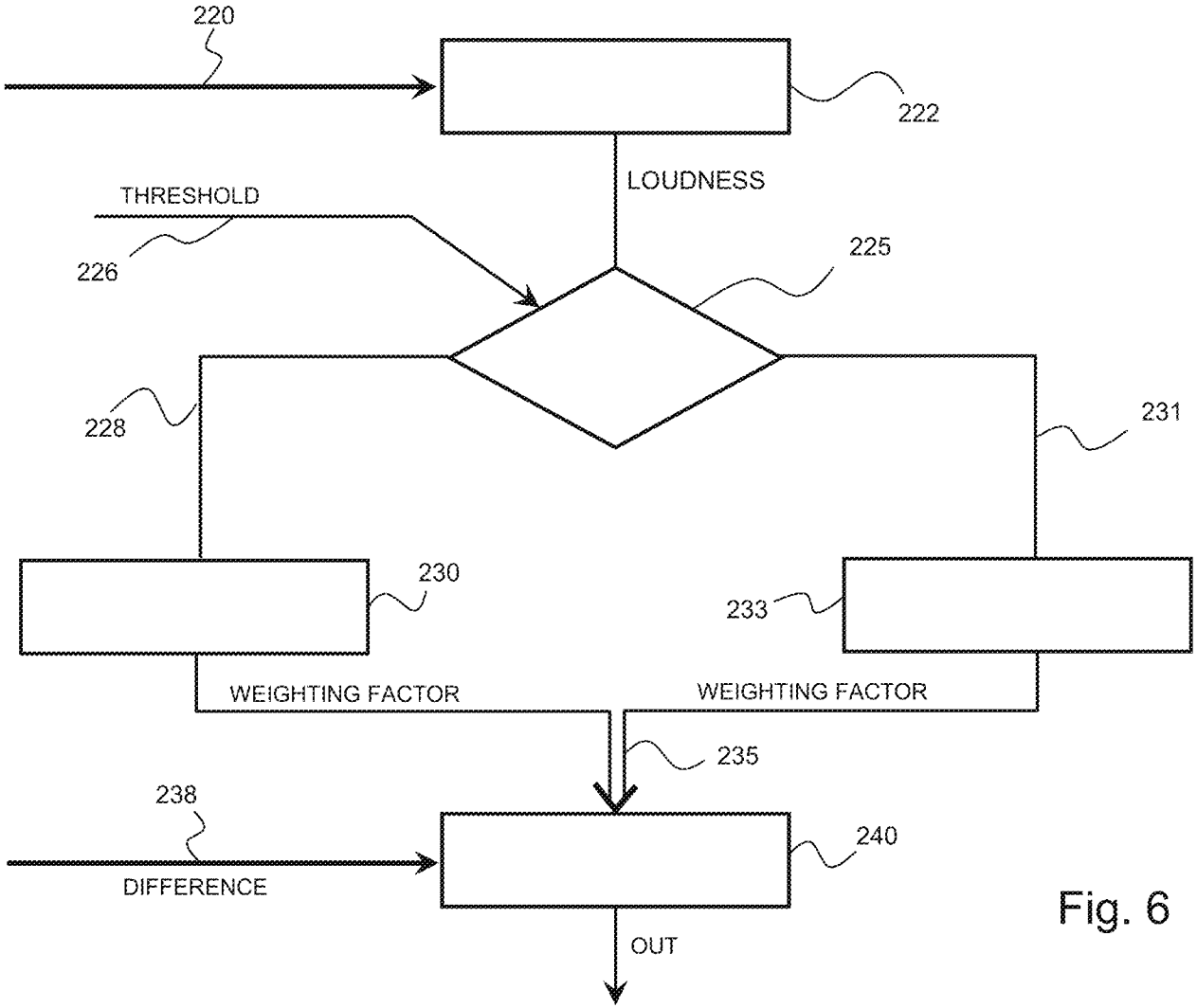
FIG. 6 is a schematic illustration of a loudness dependent weighing of disturbance.

FIG. 6 illustrates an overview of a method of weighing the disturbance or noise with respect to the loudness value. Although the method as illustrated in FIG. 6 only focuses on the relevant parts relating to determining the loudness value and performing the weighing of disturbances, it will be appreciated that this method can be incorporated as part of an evaluation method as described in this document, or an alternative thereof.

In step 222, a loudness value is determined for each frame of the reference signal 220. This step may be implemented in step 33 of FIG. 1, or as described above in step 35' also depicted in FIG. 1 as a preferred alternative. The skilled person may appreciate that the loudness value may be determined somewhere else in the method, provided that the loudness value is timely available upon performing the weighing.

In step 225, the loudness value determined in step 222 is compared to a threshold 226. The outcome of this comparison may either be that the loudness value is larger than the threshold 226, in which case the method continues via of 228; or that the loudness value may be smaller than the threshold 226, in which case the method continues through path 231.

If the loudness value is larger than the threshold (path 228), in step 230 the loudness dependent weighting factor is determined. In the present embodiment, the weighting factor is set at 1.0 in order to fully take into account the disturbance in the degraded signal. The skilled person will appreciate that the situation where the loudness value is larger than the threshold corresponds to the speech signal carrying information at the present time (the reference signal frame coincides with the actual words being spoken). The method is not limited to a weighting factor of 1.0 in the abovementioned situation; the skilled person may opt to use any other value or dependency deemed suitable for a given situation. The method here primarily focuses on making a distinction between disturbances encountered during speech and disturbances encountered during (almost) silent periods, en treating the disturbances differently in both regimes.

In case the loudness value is smaller than the threshold and the method continues through path 231, in step 233 the weighting value is determined by setting the weighting factor as being dependent on the loudness value. Good results have been experienced by directly using the loudness value as weighting factor. However any suitable dependency may be applied, i.e. linear, quadratic, a polynomial of any suitable order, or another dependency. The weighting factor must be smaller than 1.0 as will be appreciated.

As an alternative to the above described loudness dependent weighting factor, it is also possible to include the frequency dependency of the loudness in the method. In that case, the weighting factor will not only be dependent on the loudness, but also on the frequency of the disturbance in the speech signal.

The weighting factor determined in either one of steps 230 and 233 is used as an input value 235 for weighing the importance of disturbances in step 240 as a function of whether or not the degraded signal actually carries spoken voice at the present frame. In step 240, the difference signal 238 is received and the weighting factor 235 is applied for providing the desired output (OUT).

The invention may be practiced differently than specifically described herein, and the scope of the invention is not limited by the above described specific embodiments and drawings attached, but may vary within the scope as defined in the appended claims.

REFERENCE SIGNS

3 reference signal X(t)
5 degraded signal Y(t), amplitude-time
7 difference calculation
8 first variant of difference calculation
9 second variant of difference calculation
10 third variant of difference calculation
12 difference signal
13 internal ideal pitch-loudness-time $LX_{ideal}{}^{(f)}{}_{n}$
14 internal degraded pitch-loudness-time $LY_{deg}{}^{(f)}{}_{n}$
17 global scaling towards fixed level
18 windowed FFT
20 scaling factor SP
21 warp to Bark
25 (super) silent frame detection
26 global & local scaling to degraded level
27 partial frequency compensation
30 excitation and warp to sone
31 absolute threshold scaling factor SL
32 LOUDNESS
32' LOUDNESS (determined according to alternative step 35')
33 global low level noise suppression
34 local scaling if Y<X
35 partial frequency compensation
35' (alternative) determine loudness
36 scaling towards degraded level
37 global low level noise suppression
40 FREQ NOISE REVERB indicators

41 FREQ indicator
42 NOISE indicator
43 REVERB indicator
44 $PW_R_{overall}$ indicator (overall audio power ratio between degr. and ref signal)
45 $PW_R_{frame}$ indicator (per frame audio power ratio between degr. and ref. signal)
46 scaling towards playback level
47 calibration factor C
49 windowed FFT
52 frequency align
54 warp to Bark
55 scaling factor SP
56 degraded signal pitch-power-time $PPY^{(f)}_n$
58 excitation and warp to sone
59 absolute threshold scaling factor SL
60 global high level noise suppression
61 degraded signal pitch-loudness-time
63 local scaling if Y>X
64 scaling towards fixed internal level
65 global high level noise suppression
70 reference spectrum
72 degraded spectrum
74 ratio of ref and deg pitch of current and +/−1 surrounding frame
77 preprocessing
78 smooth out narrow spikes and drops in FFT spectrum
79 take log of spectrum, apply threshold for minimum intensity
80 flatten overall log spectrum shape using sliding window
83 optimization loop
84 range of warping factors: [min pitch ratio<=1<=max pitch ratio]
85 warp degraded spectrum
88 apply preprocessing
89 compute correlation of spectra for bins<1500 Hz
90 track best warping factor
93 warp degraded spectrum
94 apply preprocessing
95 compute correlation of spectra for bins<3000 Hz
97 keep warped degraded spectrum if correlation sufficient restore original otherwise
98 limit change of warping factor from one frame to the next
100 ideal regular
101 degraded regular
104 ideal big distortions
105 degraded big distortions
108 ideal added
109 degraded added
112 ideal added big distortions
113 degraded added big distortions
116 disturbance density regular select
117 disturbance density big distortions select
119 added disturbance density select
120 added disturbance density big distortions select
121 $PW_R_{overall}$ input to switching function 123
122 $PW_R_{frame}$ input to switching function 123
123 big distortion decision (switching)
125 correction factors for severe amounts of specific distortions
125' correction factors for severe amounts of specific distortions
127 level
127' level
128 frame repeat
128' frame repeat
129 timbre
129' timbre
130 spectral flatness
130' spectral flatness
131 noise contrast in silent periods
131' noise contrast in silent periods
133 loudness dependent disturbance weighing
133' loudness dependent disturbance weighing
134 Loudness of reference signal
134' Loudness of reference signal
136 align jumps
136' align jumps
137 clip to maximum degradation
137' clip to maximum degradation
138 disturbance variance
138' disturbance variance
140 loudness jumps
140' loudness jumps
142 final disturbance density $D^{(f)}_n$
143 final added disturbance density $D^{(f)}_n$
145 $L_3$ frequency integration
146 $L_1$ spurt integration
147 $L_3$ time integration
148 $L_5$ frequency integration
149 $L_1$ spurt integration
150 $L_1$ time integration
153 $L_1$ frequency integration
155 $L_4$ spurt integration
156 $L_2$ time integration
159 $L_1$ frequency integration
160 $L_1$ spurt integration
161 $L_2$ time integration
170 mapping to intermediate MOS score
171 MOS like intermediate indicator
175 MOS scale compensations
176 raw MOS scores
180 mapping to MOS-LQO
181 MOS LQO
185 Intensity over time for short sinusoidal tone
187 short sinusoidal tone
188 masking threshold for a second short sinusoidal tone
195 Intensity over frequency for short sinusoidal tone
198 short sinusoidal tone
199 making threshold for a second short sinusoidal tone
205 Intensity over frequency and time in 3D plot
211 masking threshold used as suppression strength leading to a sharpened internal representation
220 reference signal frames
222 determine LOUDNESS
225 compare LOUDNESS to THRESHOLD
226 THRESHOLD
228 LOUDNESS>THRESHOLD
230 WEIGHTING FACTOR=1,0
231 LOUDNESS<THRESHOLD
233 WEIGHTING FACTOR linear dependent on LOUDNESS
235 determined value for WEIGHTING VALUE
238 difference signal/disturbance
240 weighing step of disturbance

The invention claimed is:

1. Method of testing the sufficiency of an audio transmission system for conveying speech signals, by evaluating intelligibility of a degraded speech signal received from an audio transmission system, wherein a reference speech signal is conveyed through said audio transmission system to provide said degraded speech signal, wherein the method comprises:

sampling said reference speech signal into a plurality of reference signal frames, sampling said degraded speech signal into a plurality of degraded signal frames, and forming frame pairs by associating said reference signal frames and said degraded signal frames with each other;

for each frame pair pre-processing said reference signal frames and said degraded signal frames for enabling a comparison between said frames of each frame pair;

providing for each frame pair one or more difference functions representing a difference between said degraded signal frame and said associated reference signal frame;

selecting at least one of said difference functions for compensating said at least one of said difference functions for one or more disturbance types, such as to provide for each frame pair one or more disturbance density functions adapted to a human auditory perception model, wherein said selecting is performed by comparing a disturbance level of said degraded signal with a threshold disturbance level; and deriving from said disturbance density functions of a plurality of frame pairs an overall quality parameter, said quality parameter being at least indicative of said intelligibility of said degraded speech signal, and providing an output signal indicative of the derived overall quality parameter;

wherein said method comprises a step of:

determining at least one switching parameter indicative of an audio power level of said degraded signal, and using said at least one switching parameter for determining or adapting said threshold disturbance level that is used in performing said selecting of said at least one of said difference functions for optimizing said method for audio power level conditions of said degraded signal for assessment of said intelligibility of said degraded speech signal for said evaluation;

said method further comprising applying said derived overall quality parameter to test the sufficiency of the audio transmission system for conveying speech signals.

2. Method according to claim 1, wherein said at least one switching parameter includes an overall audio power of said degraded signal determined from a plurality of frames, or an overall audio power ratio between said degraded signal and said reference signal determined from a plurality of frames.

3. Method according to claim 1, wherein said at least one switching parameter includes a per frame audio power of said degraded signal determined for each frame, or a per frame overall audio power ratio between said degraded signal and said reference signal determined for each frame, for including variations in audio power or audio power ratio between frames.

4. Method according to claim 1, wherein said one or more difference functions include at least one of a per frame added disturbance difference function representing signal components present in said degraded signal and absent in said reference signal, a per frame regular disturbance difference function representing any disturbances in said degraded signal, a strong level disturbance difference function representing disturbance components in said degraded signal for which a difference in audio power between the reference and degraded signal exceeds a predetermined threshold, a normal level disturbance difference function representing disturbance components in said degraded signal for which a difference in audio power between the reference and degraded signal is below said predetermined threshold, and difference functions representing a combination of said per frame added disturbance difference function with said strong level disturbance difference function, a combination of said per frame added disturbance difference function with said normal level disturbance difference function, a combination of said per frame regular disturbance difference function with said strong level disturbance difference function, and a combination of said per frame regular disturbance difference function with said normal level disturbance difference function.

5. Method according to claim 1, wherein said step of compensating comprises compensating said at least one of said difference functions such as to provide an added disturbance density function and a normal disturbance density function.

6. Method according to claim 1, wherein said degraded signal frame comprises a degraded signal representation representing said degraded speech signal at least in terms of pitch and loudness.

7. Method according to claim 1, wherein said method of evaluating intelligibility of said degraded speech signal is based on a perceptual objective listening quality assessment algorithm (POLQA).

8. Apparatus for testing the sufficiency of an audio transmission system for conveying speech signals, by evaluating intelligibility of a degraded speech signal, comprising:

a receiver to receive said degraded speech signal from an audio transmission system conveying a reference speech signal, and to receive said reference speech signal;

a sampler to sample said reference speech signal into a plurality of reference signal frames, and to sample said degraded speech signal into a plurality of degraded signal frames;

a processor forming frame pairs by associating each reference signal frame with a corresponding degraded signal frame, pre-processing each reference signal frame and each degraded signal frame, and providing each frame pair one or more difference functions representing a difference between said degraded and said reference signal frame;

the processor selecting at least one of said difference functions and being configured for comparing a disturbance level of said degraded signal with a threshold disturbance level for performing said selecting;

the processor compensating said at least one of said difference functions for one or more disturbance types, such as to provide for each frame pair one or more disturbance density functions adapted to a human auditory perception model; and wherein said processor is further configured for deriving from said disturbance density functions of a plurality of frame pairs an overall quality parameter being at least indicative of said intelligibility of said degraded speech signal, for providing an output signal indicative of the derived overall quality parameter, and for applying said derived overall quality parameter to test the sufficiency of the audio transmission system for conveying speech signals;

wherein said processor is further configured for determining at least one switching parameter indicative of an audio power level of said degraded signal, and providing said switching parameter to a selector for using said at least one switching parameter for determining or adapting said threshold disturbance level that is used in performing said selecting of said at least one of said difference functions for optimizing said method for audio power level conditions of said degraded signal for assessment of said intelligibility of said degraded speech signal for said evaluation.

9. Apparatus according to claim 8, wherein said processor is configured for determining said at least one switching parameter such as to include an overall audio power of said degraded signal determined from a plurality of frames, or an overall audio power ratio between said degraded signal and said reference signal determined from a plurality of frames.

10. Apparatus according to claim 8, wherein said processor is configured for determining said at least one switching parameter such as to include a per frame audio power of said degraded signal determined for each frame, or a per frame overall audio power ratio between said degraded signal and said reference signal determined for each frame, for including variations in audio power or audio power ratio between frames.

11. Apparatus according to claim 8, wherein for providing said one or more difference functions for each frame, said processor is further configured for providing at least one of a per frame added disturbance difference function representing signal components present in said degraded signal and absent in said reference signal, a per frame regular disturbance difference function representing any disturbances in said degraded signal, a strong level disturbance difference function representing disturbance components in said degraded signal for which a difference in audio power between the reference and degraded signal exceeds a predetermined threshold, a normal level disturbance difference function representing disturbance components in said degraded signal for which a difference in audio power between the reference and degraded signal is below said predetermined threshold, and difference functions representing a combination of said per frame added disturbance difference function with said strong level disturbance difference function, a combination of said per frame added disturbance difference function with said normal level disturbance difference function, a combination of said per frame regular disturbance difference function with said strong level disturbance difference function, and a combination of said per frame regular disturbance difference function with said normal level disturbance difference function.

12. A non-transitory computer readable medium having a computer program embodied thereon for testing the sufficiency of an audio transmission system for conveying speech signals, by evaluating intelligibility of a degraded speech signal received from an audio transmission system, wherein a reference speech signal is conveyed through said audio transmission system to provide said degraded speech signal, the computer program including instructions for causing a processor to perform:

sampling said reference speech signal into a plurality of reference signal frames, sampling said degraded speech signal into a plurality of degraded signal frames, and forming frame pairs by associating said reference signal frames and said degraded signal frames with each other;

for each frame pair pre-processing said reference signal frames and said degraded signal frames for enabling a comparison between said frames of each frame pair;

providing for each frame pair one or more difference functions representing a difference between said degraded signal frame and said associated reference signal frame;

selecting at least one of said difference functions for compensating said at least one of said difference functions for one or more disturbance types, such as to provide for each frame pair one or more disturbance density functions adapted to a human auditory perception model, wherein said selecting is performed by comparing a disturbance level of said degraded signal with a threshold disturbance level; and deriving from said disturbance density functions of a plurality of frame pairs an overall quality parameter, said quality parameter being at least indicative of said intelligibility of said degraded speech signal, and providing an output signal indicative of the derived overall quality parameter, and applying said derived overall quality parameter to test the sufficiency of the audio transmission system for conveying speech signals;

wherein the instructions further cause the processor to: determine at least one switching parameter indicative of an audio power level of said degraded signal, and using said at least one switching parameter for determining or adapting said threshold disturbance level that is used in performing said selecting of said at least one of said difference functions for optimizing said method for audio power level conditions of said degraded signal for assessment of said intelligibility of said degraded speech signal for said evaluation.

13. The non-transitory computer readable medium of claim 12, wherein said at least one switching parameter includes an overall audio power of said degraded signal determined from a plurality of frames, or an overall audio power ratio between said degraded signal and said reference signal determined from a plurality of frames.

14. The non-transitory computer readable medium of claim 12, wherein said at least one switching parameter includes a per frame audio power of said degraded signal determined for each frame, or a per frame overall audio power ratio between said degraded signal and said reference signal determined for each frame, for including variations in audio power or audio power ratio between frames.

15. The non-transitory computer readable medium of claim 12, wherein said one or more difference functions include at least one of a per frame added disturbance difference function representing signal components present in said degraded signal and absent in said reference signal, a per frame regular disturbance difference function representing any disturbances in said degraded signal, a strong level disturbance difference function representing disturbance components in said degraded signal for which a difference in audio power between the reference and degraded signal exceeds a predetermined threshold, a normal level disturbance difference function representing disturbance components in said degraded signal for which a difference in audio power between the reference and degraded signal is below said predetermined threshold, and difference functions representing a combination of said per frame added disturbance difference function with said strong level disturbance difference function, a combination of said per frame added disturbance difference function with said normal level disturbance difference function, a combination of said per frame regular disturbance difference function with said strong level disturbance difference function, and a combination of said per frame regular disturbance difference function with said normal level disturbance difference function.

16. The non-transitory computer readable medium of claim 12, wherein said step of compensating comprises compensating said at least one of said difference functions such as to provide an added disturbance density function and a normal disturbance density function.

17. The non-transitory computer readable medium of claim 12, wherein said reference signal frame comprises a reference signal representation representing said reference speech signal at least in terms of pitch and loudness.

18. The non-transitory computer readable medium of claim 12, wherein said degraded signal frame comprises a degraded signal representation representing said degraded speech signal at least in terms of pitch and loudness.

19. The non-transitory computer readable medium of claim 12, wherein said evaluating intelligibility of said degraded speech signal is based on a perceptual objective listening quality assessment algorithm (POLQA).

20. Computer program product comprising the non-transitory computer readable medium of claim 12.

* * * * *